US005216998A

United States Patent [19]

Hosoda et al.

[11] Patent Number: 5,216,998

[45] Date of Patent: Jun. 8, 1993

[54] EVAPORATIVE FUEL-PURGING CONTROL SYSTEM FOR INTERNAL COMBUSTION ENGINES

[75] Inventors: Fumio Hosoda; Sachito Fujimoto; Masakazu Kitamoto; Kazumi Yamazaki, all of Wako, Japan

[73] Assignee: Honda Giken Kogyo K.K., Tokyo, Japan

[21] Appl. No.: 812,722

[22] Filed: Dec. 23, 1991

[30] Foreign Application Priority Data

Dec. 28, 1990 [JP] Japan ..... 2-417321
Mar. 6, 1991 [JP] Japan ..... 3-65527

[51] Int. Cl.[5] ..... F02D 41/14; F02M 33/04
[52] U.S. Cl. ..... 123/698; 123/520
[58] Field of Search ..... 123/698, 520

[56] References Cited

U.S. PATENT DOCUMENTS 4,683,861 8/1987 Breitkreuz et al. ..... 123/520
4,741,318 5/1988 Kortge et al. ..... 123/520
5,060,621 10/1991 Cook et al. ..... 123/520

FOREIGN PATENT DOCUMENTS 57-129247 8/1982 Japan .
58-30458 2/1983 Japan .
61-129454 6/1986 Japan .
62-131962 6/1987 Japan .
62-233466 10/1987 Japan .
63-85249 4/1988 Japan .
63-111277 5/1988 Japan .
63-189639 8/1988 Japan .

*Primary Examiner*—Andrew M. Dolinar
*Attorney, Agent, or Firm*—Arthur L. Lessler

[57] ABSTRACT

An evaporative fuel-purging control system for an internal combustion engine having a canister in which evaporative fuel from a fuel tank is absorped. Purge control valves are arranged between the canister and the intake system of the engine for controlling the flow rate of evaporative fuel supplied from the canister to the intake system. An ECU is responsive to an output from an exhaust gas ingredient concentration sensor arranged in the exhaust system of the engine for calculating an air-fuel ratio correction coefficient, based upon the output from the exhaust gas ingredient concentration sensor and controlling the air-fuel ratio of a mixture supplied to the engine by the use of the air-fuel ratio correction coefficient. The ECU calculates an average value of the air-fuel ratio correction coefficient, and is responsive to the calculated average value for controlling the purge control valves.

10 Claims, 9 Drawing Sheets

CALCULATION OF KAVE2
S21
TW ≧ TW3 ?
NO
YES
S22
KAVE2 = INITIAL VALUE
S23
TW ≧ TW1 ?
YES
NO
S24
STOP PURGING
S25
IS THROTTLE VALVE FULLY CLOSED ?
YES
NO
S26
KAVE2 = CREF4/256² × KO2P + (256²−CREF4)/256² × KAVE2
EXIT

| NE \ θ TH | THQPG0 | THQPG1 | · · · · · · | THQPG7 |
|---|---|---|---|---|
| NQPG0 | QPG(0,0) | QPG(0,1) | · · · · · · | QPG(0,7) |
| NQPG1 | QPG(1,0) | QPG(1,1) | · · · · · · | QPG(1,7) |
| NQPG2 | QPG(2,0) | QPG(2,1) | · · · · · · | QPG(2,7) |
| NQPG3 | QPG(3,0) | QPG(3,1) | · · · · · · | QPG(3,7) |

EVAPORATIVE FUEL-PURGING CONTROL SYSTEM FOR INTERNAL COMBUSTION ENGINES

BACKGROUND OF THE INVENTION

1. Field of the Invention

This invention relates to an evaporative fuel-purging control system for an internal combustion engine having an evaporative fuel-emission suppression system, and more particularly to an evaporative fuel-purging control system of this kind which controls the flow rate at which evaporative fuel is purged into the intake system of the engine.

2. Prior Art

Conventionally, evaporative fuel-emission suppression systems have been widely used in internal combustion engines, which operate to prevent evaporative fuel from being emitted from a fuel tank into the atmosphere, by temporarily storing evaporative fuel from the fuel tank in a canister, and purging same into the intake system of the engine. Purging of evaporative fuel into the intake system causes instantaneous enriching of an air-fuel mixture supplied to the engine. If the purged evaporative fuel amount is small, the air-fuel ratio of the mixture will then be promptly returned to a desired value, with almost no fluctuation.

However, if the purged amount is large, the air-fuel ratio of the mixture fluctuates. To prevent such fluctuations, there have been proposed the following systems:

(i) a purging gas flow rate control system which reduces the purging amount from the start of the engine immediately after refueling or fill-up until the speed of a vehicle in which the engine is installed reaches a predetermined value, and also reduce the purging amount after the vehicle speed has reached the predetermined value and until the accumulated time period during which the vehicle speed exceeds a predetermined value, to thereby prevent fluctuations in the air-fuel ratio due to purging immediately after a fill-up when a large amount of fuel vapor can be produced in the fuel tank (e.g. Japanese Provisional Patent Publication (Kokai) No. 63-111277);

(ii) an air-fuel ratio control system which effects purging of evaporative fuel in such a small amount as to cause almost no fluctuation of the air-fuel ratio, detects an amount of variation of an air-fuel ratio correction coefficient applied to feedback control of the air-fuel ratio, which is caused by the purging, forecast from the detected variation amount a value of the air-fuel ratio correction coefficient which should be assumed when the purging amount is large, and applies the forecast value as the air-fuel ratio correction coefficient in the feedback control when the actual purging amount becomes large, so as to reduce the fuel amount supplied to the engine, whereby fluctuations in the air-fuel ratio can be suppressed even when the purging amount is large (e.g. Japanese Provisional Patent Publication (Kokai) No. 62-131962;

(iii) a purging gas flow rate control system which controls the purging amount by the use of an output from an exhaust gas ingredient concentration sensor provided in the exhaust system of an internal combustion engine, or an air-fuel ratio correction coefficient calculated from the sensor output (e.g. Japanese Provisional Patent Publications (Kokai) Nos. 57-129247, 58-30458, 61-129454, 62-233466, and 63-85249.

However, the above system (i) merely reduces the purging amount under predetermined conditions determined by the vehicle speed and the predetermined time period after a fill-up, but does not effect control of the purging amount based upon the actual amount of fuel vapor gas (vapor amount). Therefore, since the vapor amount is unknown when a long time period has elapsed after a fill-up, and the actual vapor amount is different depending upon the residual fuel amount in the fuel tank even immediately after a fill-up, it is impossible to eliminate fluctuations in the air-fuel ratio and enable the evaporative fuel-emission suppression system to exhibit its full suppressing capacity, at the same time. That is, generally in conventional evaporative fuel-emission suppression systems, to prevent fluctuations in the air-fuel ratio, the purging amount is set to a moderate amount such that the width of air-fuel ratio fluctuation is kept within an allowable range even when the maximum vapor amount is produced, and therefore the total purging amount is limited.

The system (ii), which controls the fuel supply amount by the use of the air-fuel ratio correction coefficient reflecting the actual purging flow rate, can suppress fluctuations in the air-fuel ratio to be caused by purging. However, this system does not control the purging amount in response to the forecast air-fuel ratio correction coefficient. As a result, the value of the correction coefficient becomes largely deviated from a central value thereof when the purging amount is large. Particularly, when the air-fuel control has shifted from an open loop control mode to a feedback control mode, an average value of the air-fuel ratio correction coefficient, which is used as an initial value of the correction coefficient at the start of the air-fuel ratio feedback control, becomes largely deviated from the central value. If the deviated average value is actually used in the air-fuel ratio feedback control, it can result in a degradation in the control responsiveness.

Further, to operate the evaporative fuel-emission suppression system at its full capacity in order to fully suppress emission of evaporative fuel gas into the atmosphere, it is desirable to purge an amount of evaporative fuel as large as possible insofar as the air-fuel ratio fluctuation is kept within the allowable range. However, if in the systems (i) and (ii), the purging flow rate is set to such a value that the air-fuel ratio fluctuation is kept within the allowable range even if the vapor amount assumes the maximum value, the total purging amount cannot be sufficient enough to operate the evaporative fuel-emission suppression system at its full capacity even when the vapor amount is small, since the purging flow rate is thus set to the above value, though the purging amount can be increased insofar as the air-fuel ratio fluctuation lies within the allowable range, whereby the evaporative fuel-emission suppression system cannot be operated to its full capacity.

A system disclosed in Japanese Provisional Patent Publication (Kokai) No. 62-233466 amongst the systems (iii), employs a plurality of purge control valves, and calculates a forecast value of an air-fuel ratio correction coefficient to be applied during large-amount purging, based upon values of the correction coefficient during stoppage of the purging and during small-amount purging, and inhibits large-amount purging when the forecast value exceeds a predetermined value.

However, in general, the air-fuel ratio correction coefficient largely varies depending upon engine operating parameters such as intake pipe pressure, engine rotational speed, engine temperature, and intake temperature. Further, even if these parameters remain unchanged, the correction coefficient incessantly varies. Therefore, the forecast value varies with these parameters, and if the correction coefficient varies during purging stoppage and during small-amount purging, the resulting forecast value largely varies by an amount several times as large as the variation amount of the correction coefficient during purging stoppage or during small-amount purging, so that the forecast value cannot accurately show a value of the correction coefficient to be assumed during large-amount purging. As a result, there is a possibility that large-amount purging is inhibited even when it can be actually effected. Thus, the system disclosed in Publication No. 62-23346 is also unable to enable the evaporative fuel-emission suppression system to exhibit its full capacity, like the systems (i), (ii).

SUMMARY OF THE INVENTION

It is an object of the invention to provide an evaporative fuel-purging control system for an internal combustion engine, which is capable of properly controlling the flow rate at which evaporative fuel is to be purged to thereby improve the responsiveness of air-fuel ratio control, and enable an evaporative fuel-emission suppression system to exhibit its full capacity.

It is a further object of the invention to provide an evaporative fuel-purging control system for an internal combustion engine, which is capable of controlling the purging such that the air-fuel ratio of a mixture supplied to the engine is maintained exactly within a desired air-fuel ratio range without an abrupt change to thereby prevent so-called torque shock.

To attain the first-mentioned object, the present invention provides an evaporative fuel-purging control system for an internal combustion engine having an intake system, an exhaust system, a fuel tank, a canister in which evaporative fuel from the fuel tank is adsorbed, purge control valve means arranged between the canister and the intake system for controlling a flow rate of the evaporative fuel supplied from the canister to the intake system, an exhaust gas ingredient concentration sensor arranged in the exhaust system, and air-fuel ratio control means responsive to an output from the exhaust gas ingredient concentration sensor for calculating an air-fuel ratio correction coefficient based upon the output from the exhaust gas ingredient concentration sensor and controlling the air-fuel ratio of a mixture supplied to the engine by the use of the air-fuel ratio correction coefficient.

The evaporative fuel-purging control system is characterized by an improvement comprising:

Calculating means for calculating an average value of the air-fuel ratio correction coefficient; and purge control means responsive to the average value calculated by the calculating means for controlling the purge control valve means.

Preferably, the purge control means controls the purge control valve means in a manner such that as the average value of the air-fuel ratio correction coefficient is smaller, the flow rate of the evaporative fuel supplied by the purge control valve means is decreased.

Also preferably, the purge control means controls the purge control valve means in a manner such that when said average value of said air-fuel ratio correction coefficient is below a predetermined valve, the flow rate of said evaporative fuel supplied by said purge control valve means is decreased.

Advantageously, purge control means corrects the predetermined value by a second average value of the air-fuel ratio correction coefficient calculated when the supply of the evaporative fuel to the intake system is stopped.

The predetermined value is a fixed value. Alternatively, the predetermined value is a lower limit of the first mentioned average value of the air-fuel ratio correction coefficient above which the air-fuel ratio of the mixture supplied to the engine can be controlled with desired control responsiveness.

The evaporative fuel-purging control system according to the invention is also characterized by a further improvement comprising:

calculating means for calculating an average value of the air-fuel ratio correction coefficient; and selector means responsive to the average value calculated by the calculating means for selectively operating control valves.

Preferably, the selector means changes over the purge control valve means in a manner such that when the average value of the air-fuel ratio correction coefficient increases above a predetermined valve, the flow rate of the evaporative fuel supplied by the purge control valve means is increased.

Also preferably, the predetermined value is a value slightly smaller than a reference central value of the average value of the air-fuel ratio correction coefficient.

Further, the selector means changes over the purge control valve means in a manner such that when the average value of the air-fuel ratio correction coefficient decreases below a predetermined valve, the flow rate of the evaporative fuel supplied by the purge control valve means is increased. The last-mentioned the predetermined value is a lower limit of the first mentioned average value of the air-fuel ratio correction coefficient above which the air-fuel ratio of the mixture supplied to the engine can be controlled with desired control responsiveness.

Further preferably, the selector means estimates a flow rate of the evaporative fuel which can be supplied to the intake system and changes over the purge control valves in response to the estimated flow rate.

Preferably, the selector means reserves changing over the purge control valves in a direction of increasing the flow rate of the evaporative fuel, when the average value of the air-fuel ratio correction coefficient has changed by a predetermined amount or more in a direction of correcting the air-fuel ratio of the mixture supplied to the engine toward a leaner side.

The above and other objects, features, and advantages of the invention will be more apparent from the ensuring detailed description taken in conjunction with the accompanying drawings.

DETAILED DESCRIPTION

The invention will now be described in detail with reference to the drawings showing embodiments thereof.

Figure 1:
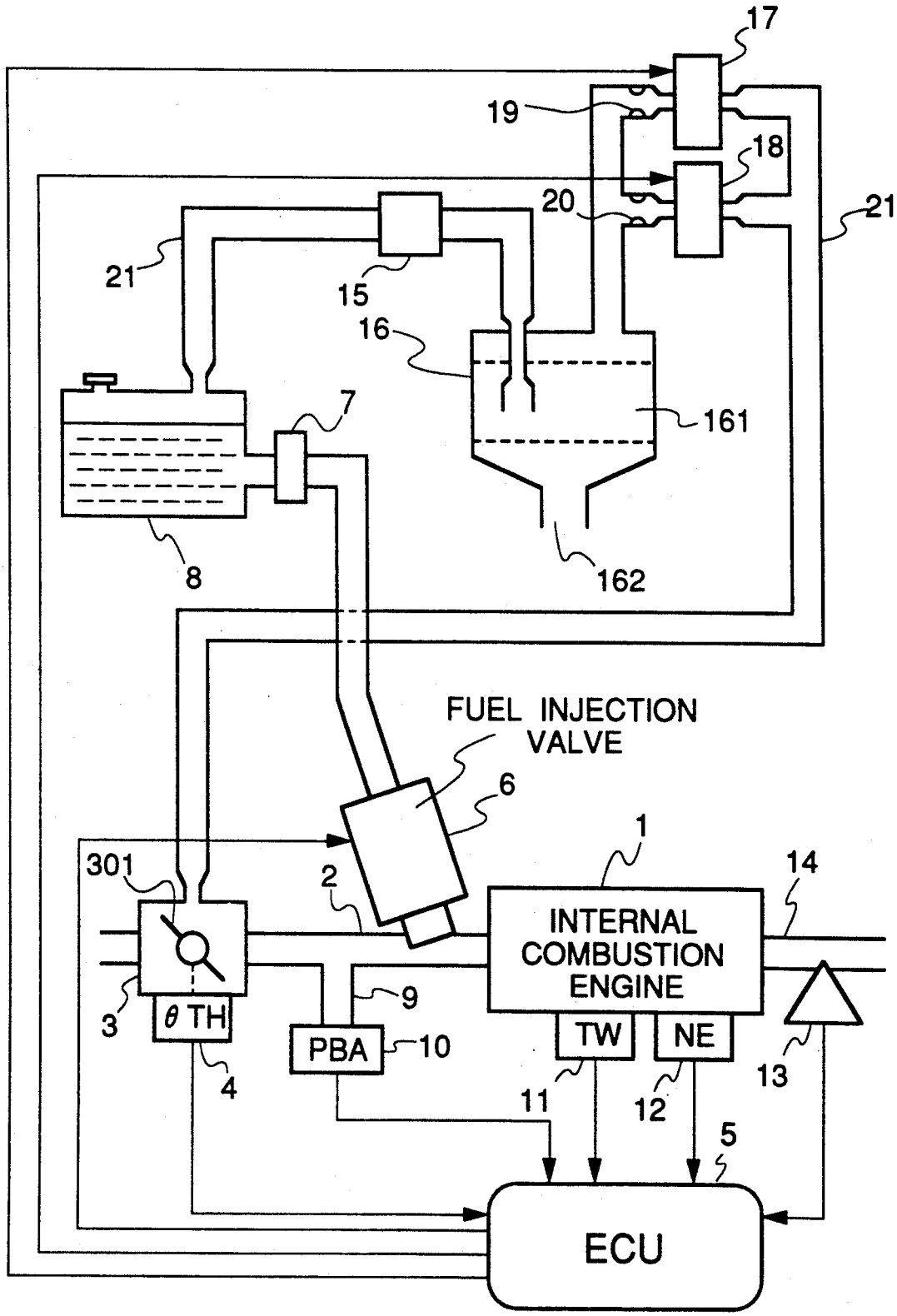
FIG. 1 is a block diagram showing the whole arrangement of a fuel supply control system for use in an internal combustion engine, including an evaporative fuel-purging control system according to an embodiment of the invention.

Referring first to FIG. 1, there is illustrated the whole arrangement of a fuel supply control system of an internal combustion engine, including an evaporative fuel-purging system according to a first embodiment of the invention. In the figure, reference numeral 1 designates an internal combustion engine for automotive vehicles. The engine is a four-cylinder type, for instance. Connected to the cylinder block of the engine 1 is an intake pipe 2 across which is arranged a throttle body 3 accommodating a throttle valve 301 therein. A throttle valve opening ($\theta_{TH}$) sensor 4 is connected to the throttle valve 301 for generating an electric signal indicative of the sensed throttle valve opening and supplying same to an electronic control unit (hereinafter called "the ECU") 5.

Fuel injection valves 6, only one of which is shown, are inserted into the interior of the intake pipe 2 at locations intermediate between the cylinder block of the engine 1 and the throttle valve 301 and slightly upstream of respective intake valves, not shown. The fuel injection valves 6 are connected to a fuel tank 8 via a fuel pump 7, and electrically connected to the ECU 5 to have their valve opening periods controlled by signals therefrom.

On the other hand, an intake pipe absolute pressure (PBA) sensor 10 is provided in communication with the interior of the intake pipe 2 via a conduit 9 at a location immediately downstream of the throttle valve 301 for supplying an electric signal indicative of the sensed absolute pressure within the intake pipe 2 to the ECU 5.

An engine coolant temperature (TW) sensor 11, which may be formed of a thermistor or the like, is mounted in the cylinder block of the engine 1, for supplying an electric signal indicative of the sensed engine coolant temperature TW to the ECU 5. An engine rotational speed (Ne) sensor 12 is arranged in facing relation to a camshaft or a crankshaft of the engine 1, not shown. The engine rotational speed sensor 12 generates a pulse as a TDC signal pulse at each of predetermined crank angles whenever the crankshaft rotates through 180 degrees, the pulse being supplied to the ECU 5.

An $O_2$ sensor 13 as an exhaust gas ingredient concentration sensor is mounted in an exhaust pipe 15 connected to the cylinder block of the engine 1, for sensing the concentration of oxygen present in exhaust gases emitted from the engine 1 and supplying an electric signal indicative of a detected value of the oxygen concentration to the ECU 5.

A conduit line (purging passage) 21 extends from an upper space in the fuel tank 8 which has an enclosed body and opens into the intake pipe 2 (into the throttle body 3 in the illustrated embodiment) at a location in the vicinity of a position of the throttle valve 301 of the throttle body 3 assumed when the throttle valve is fully closed. Arranged across the conduit line 21 is an evaporative fuel-emission suppression system (part of the evaporative fuel-purging control system) comprising a two-way valve 15, a canister 16 having an adsorbent 16', and purge control valves 17, 18 which have respective solenoids for driving same and are connected in parallel with each other. The solenoids of the purge control valves 17, 18 are connected to the ECU 5 and controlled by signals supplied therefrom.

The purge control valve 17 allows a gas, i.e. evaporative fuel at a relatively larger flow rate, and the purge control valve 18 at a relatively smaller flow rate. The purge control valves 17, 18 are arranged across respective branch lines of the conduit line 21, and a large flow rate jet restriction 19 having a relatively larger opening area is provided in the branch line on the valve 17 side, and a smaller flow rate jet restriction 20 having a relatively smaller opening area in the branch line on the valve 18 side. The conduit line 21 may have its one end opening in the intake pipe 2 at a downstream side of the throttle valve 301, instead of the location in the vicinity of the fully closed position of the throttle valve 301.

Evaporative fuel or gas (hereinafter merely referred to as "evaporative fuel") generated within the fuel tank 8 forcibly opens a positive pressure valve of the two-way valve 15 when the pressure of the evaporative fuel reaches a predetermined level, to flow through the valve 15 into the canister 16, where the evaporative fuel is absorbed by the absorbent 16 in the canister and thus stored therein. In the meanwhile, when neither of the solenoids is energized by the control signals from the ECU 5, the purge control valves 17, 18 are both closed, whereas when one of the solenoids is energized, the corresponding purge control valve is opened, whereby evaporative fuel temporarily stored in the canister 16 flows therefrom together with fresh air introduced through an outside air-introducing port 162 of the canister 16 at the flow rate determined by the corresponding purge control valve, through the purging passage 21 and the throttle body 3 into the intake pipe 2 to be supplied to the cylinders. When the fuel tank 8 is cooled due to low ambient temperature etc. so that negative pressure increases within the fuel tank 8, a negative pressure valve of the two-way valve 15 is opened to return evaporative gas temporarily stored in the canister 16 into the fuel tank 8. In the above described manner, the evaporative fuel generated within the fuel tank 8 is prevented from being emitted into the atmosphere.

The end of the purging passage 21 which opens into the interior of the throttle body 3 is exactly located at such a location that when the throttle valve 301 is in the fully closed position (at idle or at deceleration), no purging takes place (no negative pressure is introduced into the purging passage 21), whereas when the throttle valve 301 is in a position other than the fully closed position, negative pressure enabling purging is introduced into the purging passage 21, i.e. at a location on a wall of the throttle valve slightly upstream of the fully closed position of the throttle valve 301.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") which carries out failure-detecting programs, referred to hereinafter, etc., memory means storing a Ti map, referred to hereinafter, and various operational programs which are executed in the CPU and for storing results of calculations therefrom, etc., and an output circuit which outputs driving signals to the fuel injection valves 6 and the purge control valves 17, 18.

The CPU operates in response to the abovementioned signals from the sensors to determine operating conditions in which the engine 1 is operating, such as an air-fuel ratio feedback control region in which the fuel supply is controlled in response to the detected oxygen concentration in the exhaust gases, and open-loop control regions, and calculates, based upon the determined operating conditions, the valve opening period or fuel injection period TOUT over which the fuel injection valves 6 are to be opened, by the use of the following equation in synchronism with inputting of TDC signal pulses to the ECU 5.

$$TOUT = Ti \times K1 \times KO2 + K2 \quad (1)$$

where Ti represents a basic value of the fuel injection period TOUT of the fuel injection valves 6, which is read from the Ti map set in accordance with the engine rotational speed Ne and the intake pipe absolute pressure PBA.

KO2 represents an air-fuel ratio feedback correction coefficient whose value is determined in response to the oxygen concentration in the exhaust gases detected by the $O_2$ sensor 13, during feedback control, while it is set to respective predetermined appropriate values while the engine is in predetermined operating regions (the open-loop control regions) other than the feedback control region. The correction coefficient KO2 is calculated in the following manner: The output level of the $O_2$ sensor 13 is compared with a predetermined reference value. When the output level is inverted with respect to the predetermined reference value, the correction coefficient KO2 is calculated by a known proportional control method by addition of a proportional term (P-term) to the KO2 value, whereas when the former remains uninverted, it is calculated by a known integral control method by addition of an integral term (I-term) to the KO2 value. The manner of calculation of the correction coefficient KO2 is disclosed in Japanese Provisional Patent Publications (Kokai) Nos. 63-137633 and 63-189639, etc.

K1 and K2 represent other correction coefficients and correction variables, respectively, which are calculated based on various engine parameter signals to such values as to optimize characteristics of the engine such as fuel consumption and accelerability depending on operating conditions of the engine.

The CPU supplies through the output circuit, the fuel injection valves 6 with driving signals corresponding to the calculated fuel injection period TOUT determined as above, over which the fuel injection valves 6 are opened.

The ECU 5 constitutes air-fuel ratio control means, calculating means, purge control means, and selector means.

Figure 2:
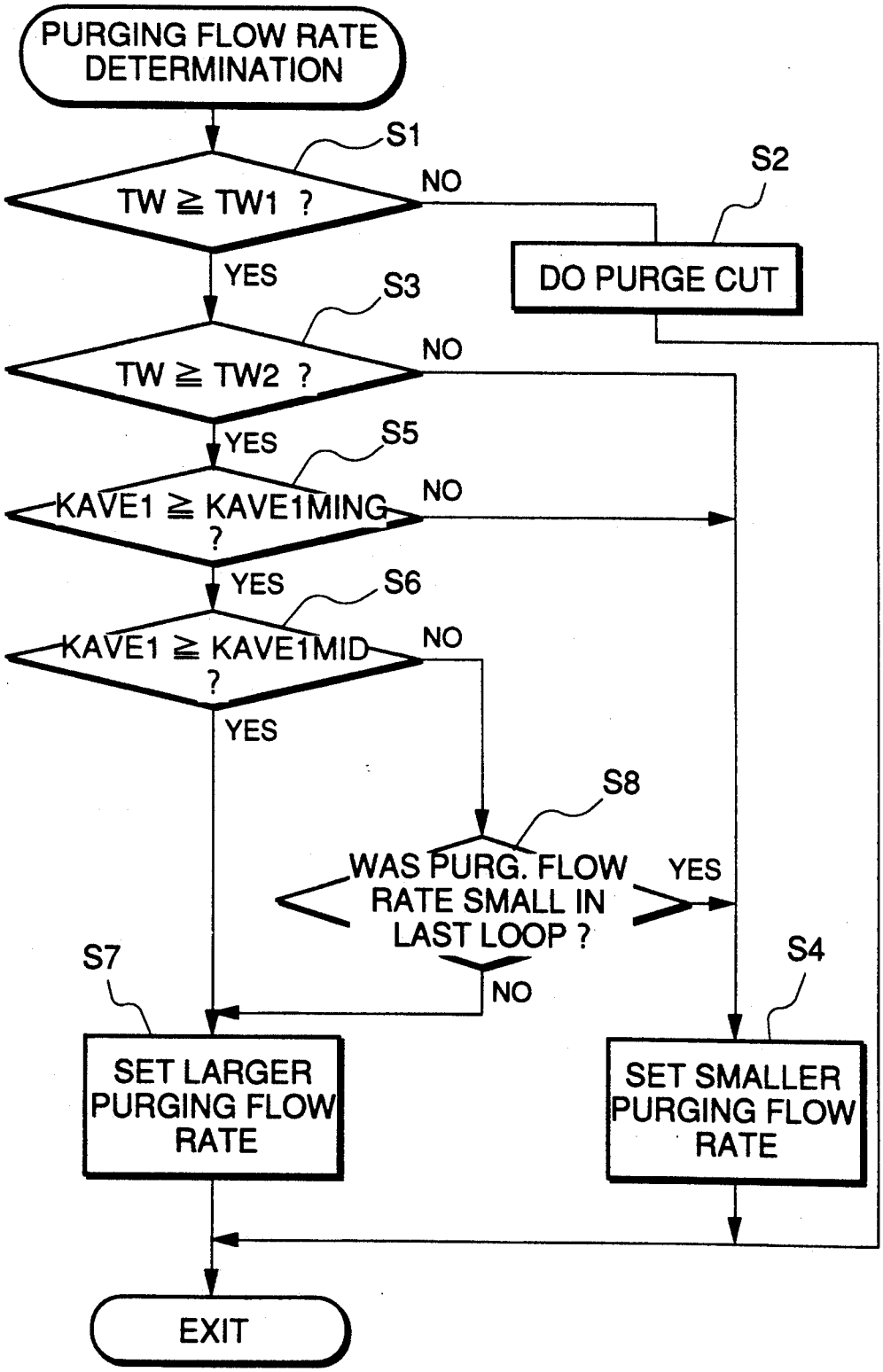
FIG. 2 is a flowchart of a program for controlling opening and closing of purge control valves (17, 18) in FIG. 1.

FIG. 2 shows a program for controlling opening and closing of the purge control valves 17, 18, which is executed by the CPU of the ECU 5. This program is a subroutine of a program for calculating the fuel injection period $T_{OUT}$.

First, at a step S1, it is determined whether or not the engine coolant temperature TW is higher than a predetermined value TW1. This predetermined value TW1 is set at a lower limit of the engine coolant temperature TW above which purging of evaporative fuel from the canister 16 to the intake pipe 2 is to be carried out (e.g. 65° C.). If the answer to this question of the step S1 is negative (NO), that is, purging should not be carried out, then the program proceeds to a step S2, where the solenoids of the purge control valves 17, 18 are both deenergized to effect purge cut, followed by terminating the program.

On the other hand, if the answer to the step S1 is affirmative (YES), it is determined at a step S3 whether or not the engine coolant temperature TW is higher than a predetermined value TW2. This predetermined value TW2 is set at a lower limit of the coolant temperature above which the value of the air-fuel ratio correction coefficient KO2 can be stable even if purging is effected at a large flow rate (e.g. 75° C.). If the answer to the step S3 is negative (NO), i.e. if the value of the correction coefficient KO2 is unstable and hence not appropriate for determination of the vapor amount, the purge control valve 18 having a relatively smaller flow rate alone is energized to open to effect purging at a smaller flow rate, at a step S4, followed by termination of the program. This can prevent the air-fuel ratio from fluctuating, since the air-fuel ratio control cannot follow up changes in the actual air-fuel ratio due to large amount purging under such an unstable condition. If the answer to the step S3 is affirmative (YES), steps S5 and S6 are executed to determine the vapor amount.

At the step S5, it is determined whether or not an average value KAVE1 of the correction coefficient KO2, which is calculated by a program shown in FIG. 3, hereinafter referred to, is larger than a predetermined value KAVE1MING, while at the step S6, it is determined whether or not the average value KAVE1 is larger than a predetermined value KAVE1MID. The predetermined value KAVE1MING is set at a lower limit (e.g. 0.7–0.8) of the average value KAVE1, above which the air-fuel ratio can be carried out with desired control response speed, while the predetermined value KAVE1MID is set at a value (e.g. 0.8–0.95) larger than the predetermined value KAVE1MING and slightly smaller than a reference central value of the average value KAVE1.

If the answer to the question of the step S5 is negative (NO), i.e. if KAVE1<KAVE1MING, it is presumed that the vapor amount is large and hence the air-fuel ratio can fluctuate, and therefore the required vapor amount is set to a smaller value (step S4). That is, the purge control valve 17 with a relatively larger flow rate is closed, and the other purge control valve 18 is opened, followed by terminating the program. On the other hand, if the answer to the step S5 is affirmative (YES), and at the same time the answer to the step S6 is affirmative (YES), that is, if KAVE1≧KAVE1MID, it is presumed that the vapor amount is small and hence even if the purging flow rate is increased, no fluctuation in the air-fuel ratio can occur. Therefore, the required purging flow rate is set to a larger value (step S7). That is, the larger flow rate purge control valve 17 is opened, and the smaller flow rate purge control valve 18 is closed, followed by terminating the program.

If the answer to the step S5 is affirmative (YES), and at the same time the answer to the step S6 is negative (NO), i.e. if KAVE1MING≦KAVE1<KAVE1MID, which means that the vapor amount is medium, it is determined at a step S8 whether or not, the purging flow rate was small in the last loop. If the answer is affirmative (YES), the program proceeds to a step S4, while if the answer is negative (NO), the program proceeds to the step S7. Therefore, frequent changeover of the purging flow rate (hunting) can be prevented.

In the above described manner, the purging flow rate is controlled in response to the average value KAVE1 of the air-fuel ratio correction coefficient KO2, the average value KAVE1 cannot be largely deviated from the reference central value, thereby enabling to improve the control responsiveness.

Further, as described above, it is so controlled that when the produced vapor amount is large, the purging flow rate is decreased, while when the produced vapor amount is small, the purging flow rate is increased. Therefore, the total purging amount (average purging flow rate) can be set to a larger value than the case where the purging flow rate is set to a fixed value irrespective of the produced vapor amount, thereby enabling the evaporative fuel-emission suppression system to exhibit its full capacity.

Figure 3:
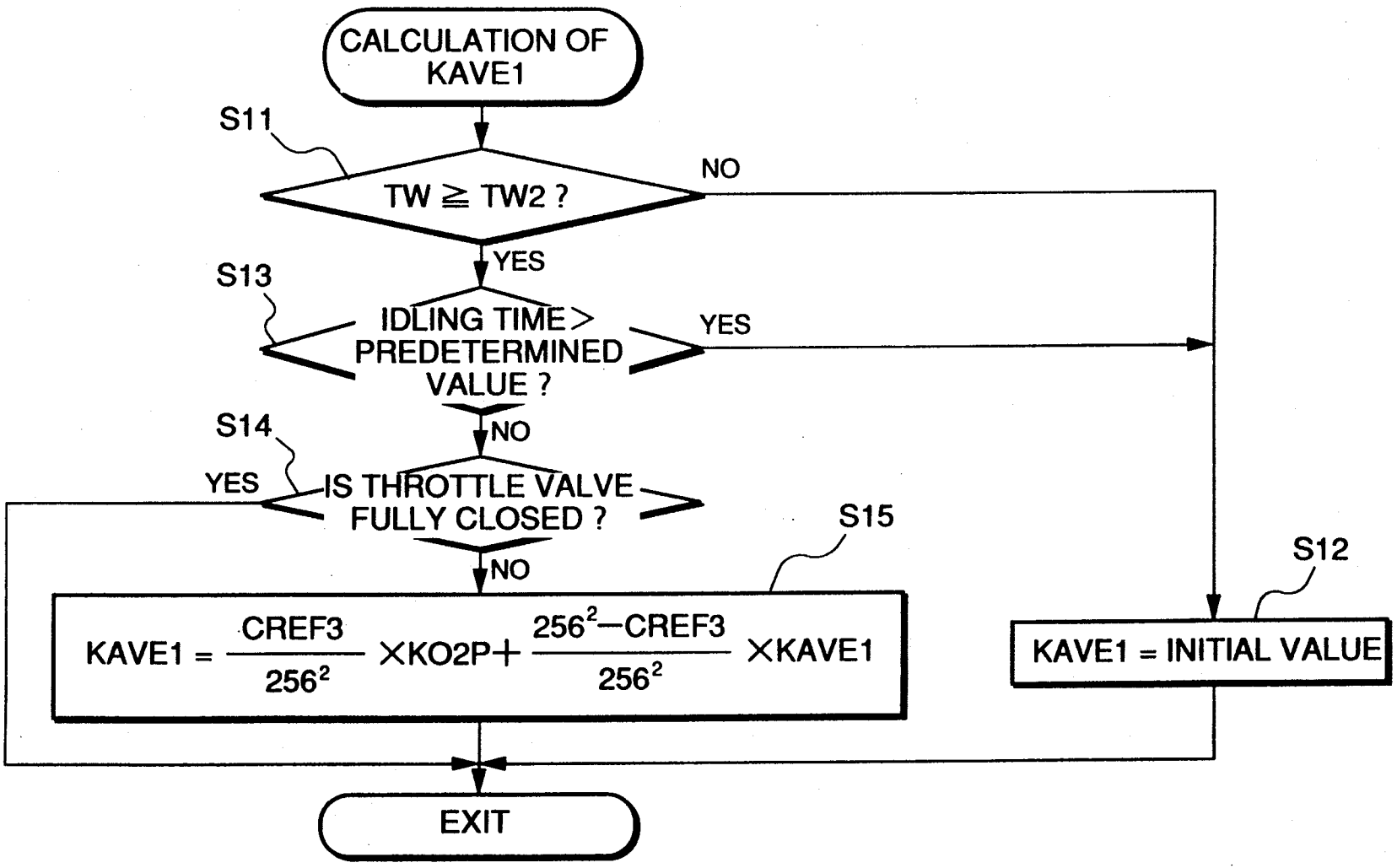
FIG. 3 is a flowchart of a program for calculating an average value (KAVE1) of an air-fuel ratio correction coefficient.

Next, reference is made to FIG. 3 showing a program for calculating the average value KAVE1 of the air-fuel ratio correction coefficient KO2 applied at the steps S5, S6 in FIG. 2. This program is executed during air-fuel ratio feedback control, in synchronism with generation of each TDC signal pulse, or at fixed time intervals, or as a background processing.

First, at a step S11 in FIG. 3, it is determined whether or not the engine coolant temperature TW is equal to or higher than the aforementioned predetermined valve TW2. If the answer is negative (NO), it is judged that the value of the air-fuel ratio correction coefficient KO2 is unstable and hence inappropriate for use in calculating the average value KAVE1. Accordingly, the average value KAVE1 is set to an initial value (e.g. 1.0) (step S12), and then the program is terminated.

On the other hand, if the answer to the step S11 is negative (NO), it is determined at a step S13 whether or not the time period over which the engine has been idling exceeds a predetermined value. This determination is for avoiding calculation of the average value KAVE1 of the correction coefficient KO2 because if the idling time period exceeds the predetermined value, an excessive amount of vapor is stored in the canister 16 so that the resulting KO2 value is too much decreased to calculate the average value KAVE1. Therefore, if the answer to the step S13 is affirmative (YES), the program proceeds to the step S12.

If the answer to the step S13 is negative (NO), it is determined at a step S14 whether or not the throttle valve 301 is in a fully closed position. If the answer is affirmative (YES), i.e. if the engine is idling or decelerating, purging is not effected, and therefore calculation of the average value KAVE1 should be inhibited. Accordingly, the program is immediately terminated.

On the other hand, if the answer to the step S14 is negative (NO), the program proceeds to a step S15 to calculate the average value KAVE1 by the use of the following equation;

$$KAVE1 = \frac{CREF3}{256^2} \times KO2P + \frac{256^2 - CREF3}{256^2} \times KAVE1 \quad (2)$$

where CREF 3 is a weighing factor which is an integer selected from 1-256², KO2P is a value of the air-fuel ratio correction coefficient KO2P calculated by P-term control, and KAVE1 on the right side is an average value KAVE1 calculated up to the last time of KAVE1 calculation.

To obtain an average value KAVE1 suitable for accurate determination of the vapor amount, the KAVE1 calculation is effected only when the engine is in predetermined conditions determined at the steps S11, S13, and S14.

The predetermined values KAVE1MING, KAVE1MID applied at the steps S5, S6 in FIG. 2 are fixed values. However, this is not limitative, but they may be variable values set as described hereinbelow.

Figure 4:
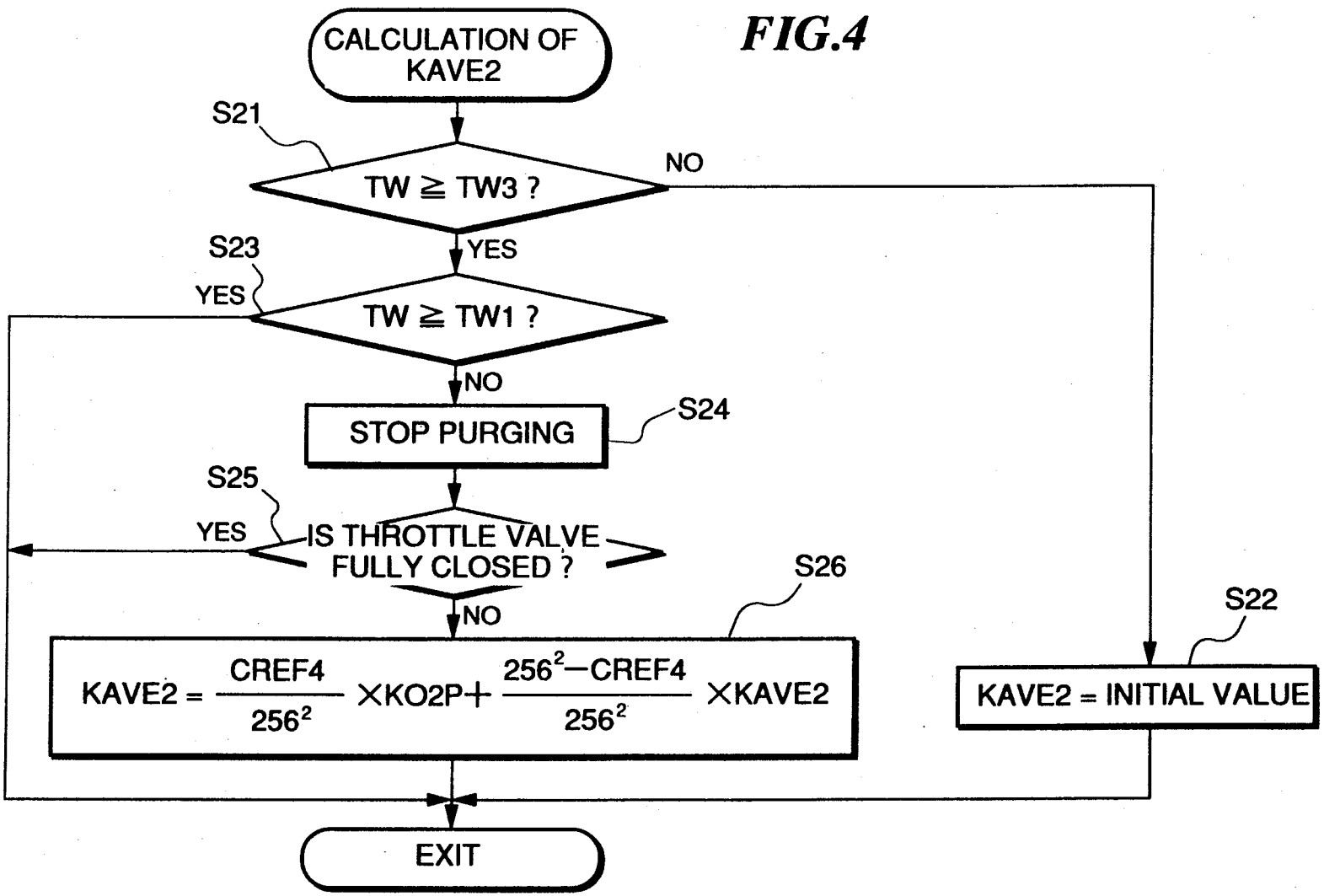
FIG. 4 is a flowchart of a program for calculating an average value (KAVE2) of the air-fuel ratio correction coefficient.

Before setting the values KAVE1MING, KAVE1MID, an average value KAVE2 of the air-fuel ratio correction coefficient KO2 is calculated during purge cut by a program shown in FIG. 4, to be used for the setting of the values KAVE1MING, KAVE2MID.

First, at a step S21 in FIG. 4, it is determined whether or not the engine coolant temperature TW is equal to or higher than a predetermined value TW3. The predetermined value TW3 is set at a lower limit (e.g. 40° C.) of the engine coolant temperature TW below which the correction coefficient KO2 presents stable values during air-fuel ratio control while purge cut is effected. If the answer to the step S21 is negative (NO), i.e. if TW<TW3, it is judged that the average value KAVE2 should not be calculated. Accordingly, the average value KAVE2 is set to an initial value (e.g. 1.0) at a step S22, followed by terminating the program.

If the answer to the step S21 is affirmative (YES), it is determined at a step S23 whether or not the engine coolant temperature TW is equal to or higher than the predetermined value TW1. If the answer is affirmative (YES), i.e. if the engine coolant temperature TW is so high as to be suitable for effecting purging, it is judged that calculation of the average value KAVE2 should not be effected. Accordingly, the program is immediately terminated.

If the answer to the step S23 is negative (NO), i.e. if TW3≦TW<TW1, purging is interrupted at a step S24, and then it is determined at a step S25 whether or not the throttle valve 301 is in a fully closed position. If the answer to the step S25 is affirmative (YES), i.e. if the engine is idling or decelerating, it is judged that the engine is not in a condition suitable for effecting purging. Accordingly, the program is immediately terminated, without calculating the average value KAVE2.

On the other hand, if the answer to the step S25 is negative (NO), the program proceeds to a step S26 where the average value KAVE2 of the correction coefficient KO2 is calculated during purge cut by the use of the following equation (3):

$$KAVE2 = \frac{CREF4}{256^2} \times KO2P + \frac{256^2 - CREF4}{256^2} \times KAVE2 \quad (3)$$

where CREF4 is a weighing factor which is an integer selected from 1–$256^2$, KO2P is a value of the correction coefficient KO2 calculated by P-term control, and KAVE2 on the right side is an average value KAVE2 calculated up to the last time of KAVE2 calculation.

In this way, the average value KAVE2 is calculated when the engine coolant temperature TW is within a range suitable for effecting purging and at the same time the engine is under a stable condition during air-fuel ratio feedback control, thereby obtaining a stable average value KAVE2 of the correction coefficient KO2 during purge cut.

Figure 5:
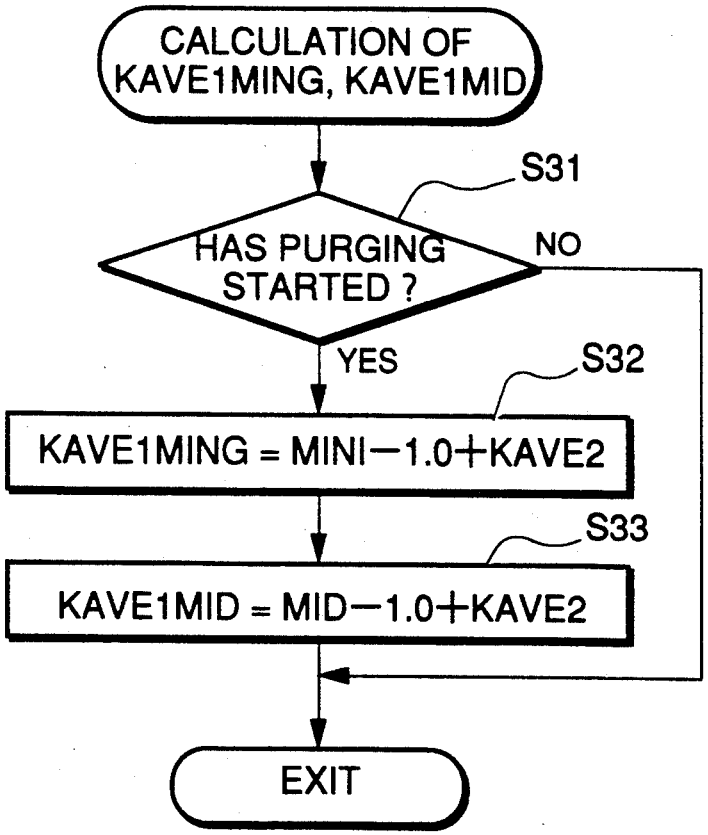
FIG. 5 is a flowchart of a program for calculating predetermined values (KAVE1MING, KAVE1MID) of the air-fuel ratio correction coefficient.

The manner of calculating the predetermined values KAVE1MING, KAVE1MID applied at the steps S5, S6 in FIG. 2, by the use of the above calculated average value KAVE2 will be described hereinbelow with reference to a program shown in FIG. 5.

First, at a step S31 in the figure, it is determined at a step S31 whether or not purging has been first started in the present loop. This determination is for allowing execution of steps S32 and S33 only one time immediately after the start of purging. If the answer to the step S31 is negative (NO), it means that the steps S32, S33 have already been executed. Accordingly, the program is immediately terminated.

If the answer to the step S31 is affirmative (YES), the program proceeds to the steps S32, S33 to calculate the predetermined values KAVE1MING, KAVE1MID by the use of the average value KAVE2 calculated by the FIG. 4 program, according to the following equations (4) and (5):

$$KAVE1MING = MIN1 - 1.0 + KAVE2 \quad (4)$$

$$KAVE1MID = MID - 1.0 + KAVE2 \quad (5)$$

where MINI is a value (e.g. 0.7–0.8) which corresponds to the predetermined value KAVE1MING which is fixed, used at the step S5 in FIG. 2, and MID is a value (e.g. 0.8–0.95) which corresponds to the predetermined value KAVE1MID which is fixed, used at the step S6 in FIG. 2.

By executing the FIG. 2 program by the use of the variable predetermined values KAVE1MING, KAVE1MID thus set, higher accuracy of detection of the vapor amount can be achieved.

Although at the steps S4, S7 in FIG. 2 the purging flow rate is set to two values, this is not limitative, but the purging flow rate may be set, e.g. to three values by providing a mode in which both of the purge control valves 17, 18 are opened, for example, and providing three predetermined ranges for the vapor flow rate which correspond, respectively, to the three values of purging flow rate. This can achieve higher accuracy of purging flow rate control. Besides, three or more purge control valves may be provided, or alternatively a single linear control valve (EACV) may be employed as the purge control valve means.

A second embodiment of the invention will now be described with reference to FIGS. 6–10. The arrangement of a fuel supply control system incorporating the second embodiment is substantially identical with that of the first embodiment of FIG. 1, described above except for the following:

While in the first embodiment the purge control valves 17, 18 have different flow rates, in the second embodiment they have the same flow rate such that when both of them are open, a larger flow rate is obtained, while when only one of them is open, a smaller flow rate is obtained.

Figure 6:
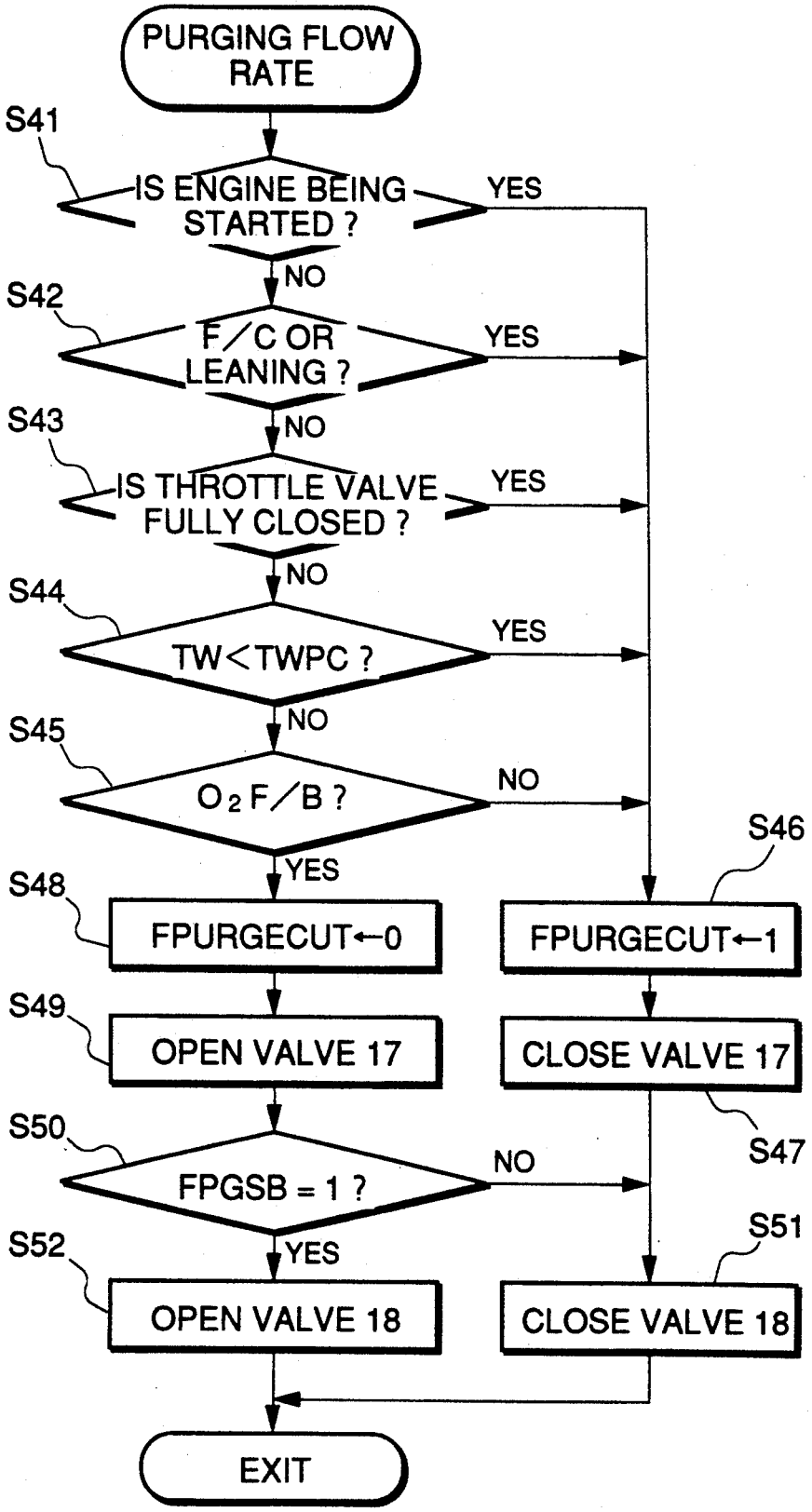
FIG. 6 is a flowchart of another program for controlling opening and closing of the purge control valves (17, 18)

FIG. 6 shows a program for controlling opening and closing of the purge control valves 17, 18, which is executed in synchronism with generation of each TPC signal pulse, or at fixed time intervals, or as a background processing.

At steps S41–S45 in FIG. 6, it is determined whether or not the engine is being started (step S41), whether or not fuel cut or air-fuel leaning control (open loop control which controls the air-fuel ratio to a value leaner than a stoichiometric value) is being effected (step S42), whether or not the throttle valve 301 is fully closed (step S43), whether or not the engine coolant temperature TW is lower than a predetermined value TWPC (step S44), and whether or not the air-fuel ratio feedback control is being effected (step S45).

If any of the steps S41–44 provides an affirmative (YES) answer or the step S45 provides a negative (NO) answer, it is judged that purging should be inhibited, and then a flag FPURGECUT is set to a value of 1 at a step S46, and at the same time the purge control valves 17, 18 are both closed at steps S47, S51, followed by terminating the program.

If all the answers to the steps S41–S44 are negative (NO) and the answer to the step S45 is affirmative (YES), it is judged that purging can be effected, and then the flag FPURGECUT is set to a value of 0 at a step S48, and the purge control valve 17 alone is opened at a step S49, followed by the program proceeding to a step S50. At the step S50, it is determined whether or not a flag FPGSB assumes a value of 1. The flag FPGSB is set to 1 by a program shown in FIG. 7 when the other purge control valve 18 is to be opened. If the answer to the step S50 is negative (NO), the purge control valve 18 is closed at a step S51, while if the answer is affirmative (YES), the valve 18 is opened at a step S52. Thus, the purging flow rate is controlled in response to the value of the flag FPGSB.

Figure 7:
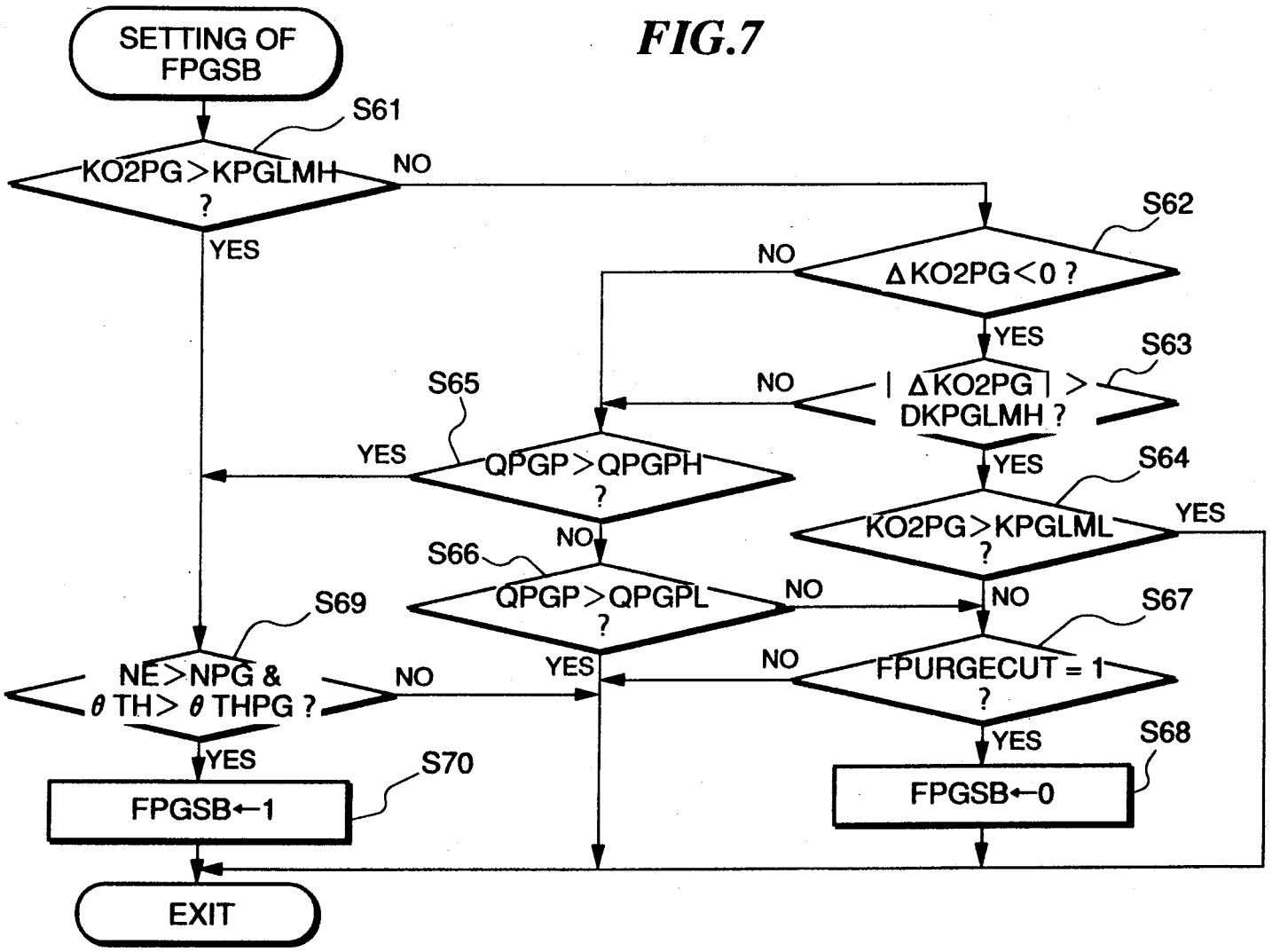
FIG. 7 is a flowchart of a program for setting a flag (FPGSB) which is used in execution of the program of FIG. 6.

FIG. 7 shows a program for setting the flag FPGSB, which is executed in synchronism with generation of each TPC signal pulse, or at fixed time intervals, or as a background processing, while the purge control valve 17 is open.

At a step S61 in FIG. 7, it is determined whether or not an average value KO2PG of the air-fuel ratio correction coefficient is larger than a first predetermined value KPGLMH. The average value KO2PG corresponds to KAVE1 in the first embodiment, and is calculated by a program shown in FIG. 8 in the present or second embodiment. The first predetermined value KPGLMH corresponds to KAVE1MID in the first embodiment, and is set to a value (e.g. 0.8–0.95) slightly smaller than a reference central value of the average value KO2PG.

Figure 8:
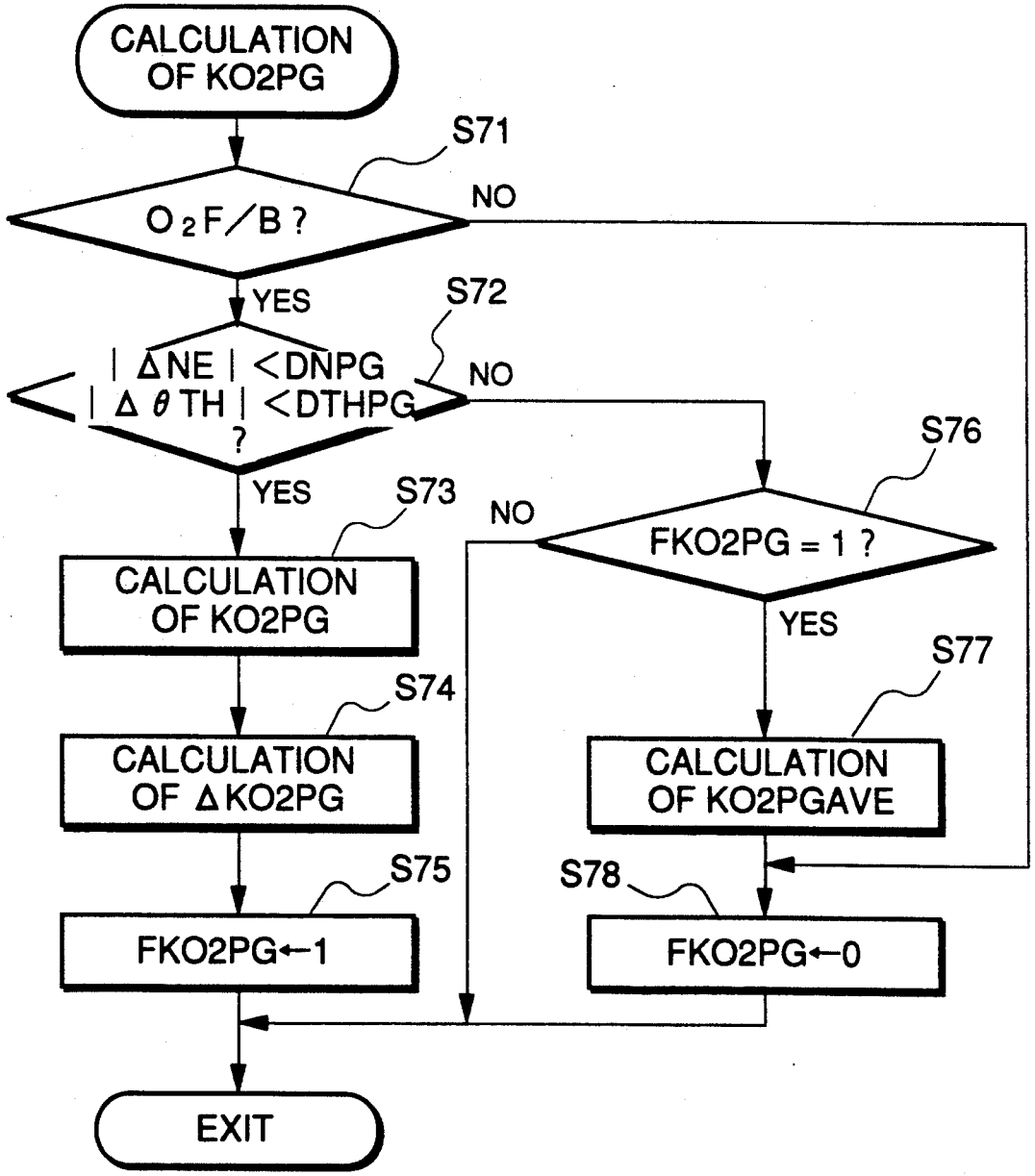
FIG. 8 is a flowchart of a program for calculating an average value (KO2PG) of the air-fuel ratio correction coefficient.

At a step S71 in FIG. 8, it is determined whether or not the air-fuel ratio feedback control is being effected. If the answer is negative (NO), a flag FKO2PG is set to a value of 0 at a step S78, followed by terminating the program. The flag FKO2PG is set to a value of 1 at a step S75 when the average value KO2PG has been calculated. If the answer to the step S71 is affirmative (YES), i.e. if the air-fuel ratio feedback control is being effected, it is determined at a step S72 whether or not the absolute values of a variation ΔNE of the engine rotational speed and a variation ΔθTH of the throttle opening (the variations ΔNE, ΔθTH are each the difference between present and immediately preceding values detected in synchronism with generation of TDC signal pulses, for example) are smaller than respective predetermined values DNDG and DTHPG. If the answer to the step S72 is affirmative (YES), i.e. if |ΔNE|<DNPG and |ΔθTH|<DTHPG, it is judged that the engine is in a steady condition, and then the average value KO2PG is calculated by the use of the following equation (6):

$$KO2PG = \frac{CREF \times KO2P}{256} + \frac{(256 - CREF) \times KO2PG}{256} \quad (6)$$

where CREF is a weighing factor set within a range of 1-256, KO2P a value of the air-fuel ratio correction coefficient calculated by P-term control, and KO2PG on the right side an average value calculated up to least time of KO2PG calculation.

At a step S74, a variation ΔKO2PG of the average value KO2PG is calculated by the use of the following equation (7):

$$\gamma KO2PG = KO2PG - KO2PGAVE \quad (7)$$

where KO2PGAVE is an average value of the average value KO2PG calculated at a step S77 by the following equation (8):

$$KO2PGAVE = \frac{CREF \times KO2PG}{256} + \frac{(256 - CREF) \times KO2PGAVE}{256} \quad (8)$$

where KO2PGAVE on the right side is an average value KO2PGAVE calculated up to the last time of KO2PGAVE calculation.

Then, the flag KO2PG is set to 1 at a step S75, followed by terminating the program.

If the answer to the step S72 is negative (NO), i.e. if |ΔNF|≧DNPG or |ΔθTH|≧DTHPG, it is determined at a step S76 whether not the flag FKO2PG assumes 1. If the answer is negative (NO), the program is immediately terminated, whereas if the answer is affirmative (YES), the average value KO2PGAVE of the KO2PG value is calculated by the equation (8) at the step S77, and the flag FKO2PG is set to 0 at a step S78, followed by terminating the program.

According to the program of FIG. 8 described above, the average value KO2PG and the variation ΔKO2PG are calculated when the engine is in a stable condition during air-fuel ratio feedback control.

Referring again to FIG. 7, when the average value KO2PG is larger than the first predetermined value KPGLMH, it is judged that the average value KO2PG is in the vicinity of the reference central value (1.0), which means that purging would not appreciably affect the air-fuel ratio. Then, it is determined at a step S69 whether or not the engine rotational speed NE and the throttle opening θTH exceed respective predetermined values NPG and θTHPG at a step S69. If the answer to the step S69 is affirmative (YES), i.e. if NE>NPG and θTH>θTHPG, it is judged that purging in an increased amount would not appreciably affect the air-fuel ratio. Accordingly, the flag FPGSB is set to 1 at a step S70, followed by terminating the program. In this manner, the purging gas flow rate can be increased without causing large fluctuations in the air-fuel ratio.

If the answer to the step S69 is negative (NO), i.e. if NE≦NPG or θTH≦θTHPG, the program is immediately terminated.

If the answer to the step S61 is negative (NO), i.e. if KO2PG≦KPGLMH, it is determined at a step S62 whether or not the variation ΔKO2PG of the average value calculated by the FIG. 8 program is smaller than 0. If the answer is affirmative (YES), i.e. if ΔKO2PG<0, it is further determined at a step S63 whether or not the absolute value of the variation ΔKO2PG is larger than a predetermined value DKPGLMH. If the answer to either the step S62 or the step S63 is negative (NO), i.e. if ΔKO2PG≧0, which means that the average value KO2PG is increasing, or |ΔKO2PG|≦DKPGLMH, which means that the average value KO2PG is gently decreasing in the direction of correcting the air-fuel ratio toward a leaner side, it is determined at a step S65 whether or not an estimated value QPGP of a possible purging gas supply flow rate is larger than a first predetermined value QPGPH. The estimated value QPGP is calculated by a program shown in FIG. 9.

Figures 9, 10:
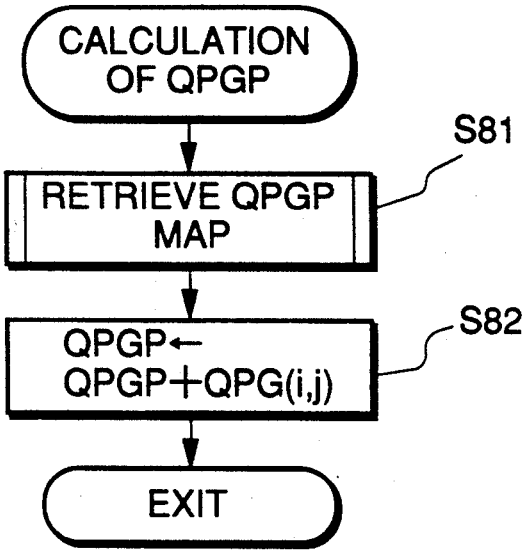
FIG. 9 is a flowchart of a program for calculating an estimated value (QPGP) of the purging flow rate.
FIG. 10 is a view showing a map which is retrieved in execution of the program of FIG. 9.

At a step S81 in FIG. 9, a QPGP map is retrieved in accordance with the engine rotational speed NE and the throttle valve opening θTH. The QPGP map is shown in FIG. 10, where map values QPG (i, j) (i=0-3, j=0-7) are set as a function of combinations of predetermined engine rotational speed values NQPGO−3 and predetermined throttle valve opening THQPGO−7. The map values QPG (i, j) include negative values assumed when the engine rotational speed NE is low and the throttle valve is almost fully closed.

At a step S82, the estimated value QPGP is calculated by integrating map values QPG (i, j) by the use of the following equation (9):

$$QPGP = QPGP + QPG(i,j) \quad (9)$$

where QPGP on the right side is a QPGP value calculated up to the last time of QPGP calculation.

Referring again to FIG. 7, if the answer to the step S65 is affirmative (YES), i.e. if QPGP>QPGPH, it is judged that purging can be promoted, and then the program proceeds to the aforesaid step S69. That is, if QPGP>QPGPH, the purge control valve 18 is allowed to open from a closed position. If the answer to the step S65 is negative (NO), i.e. if QPGP≦QPGPH, it is determined at a step S66 whether or not the estimated value QPGP is larger than a second predetermined value QPGPL smaller than the first predetermined value QPGPH. If the answer is affirmative (YES), i.e. if QPGPL<QPGP≦PQGPH, the program is immediately terminated, with the flag FPGSB held at the value assumed in the last loop. If the answer to the step S66 is negative (NO), i.e. if QPGP≦QPGPL, it is judged that purging should not be effected to a large extent, or that a purge-cut state should be continued, in other words, the purge control valve 18 can be closed from an open position without appreciably affecting the air-fuel ratio, and then the program proceeds to a step S67. At the step S67, it is determined whether or not the flag FPURGECUT assumes 1. If the answer is negative (NO), i.e. if FPURGECUT=0, the program is immediately terminated, while if the answer is affirmative (YES), i.e. if FPURGECUT = 1, the flag FPGSB is set to 0 at a step S68, followed by terminating the program. Thus, when QPGP≦QPGPL, the purge control valve 18 is allowed to be closed from an open position.

If the answers to the steps S62 and S63 are both affirmative (YES), i.e. if DKPGLMH < |ΔKO2PG|, it is judged that the average value KO2PG is abruptly decreasing in the direction of correcting the air-fuel ratio toward a leaner side. Then, it is determined at a step S64 whether or not the average value KO2PG is larger than a second predetermined value KPGLML smaller than the first predetermined value KPGLMH. The second predetermined value KPGLML corresponds to KAVE1MING used in the first embodiment and is set at a value of the order of 0.7–0.8.

If the answer to the step S64 is affirmative (YES), i.e. if KO2PG > KPGLML, the program is immediately terminated, while if the answer is negative (NO), it is judged than purging would greatly affect the air-fuel ratio, and then the program proceeds to the step S67 to in order to reduce the purging flow rate. Thus, when KO2PG≦KPGLML, the purge control valve 18 is allowed to close from an open position.

Since as noted above, when |ΔKO2PG| > DKPGLMH holds at the step S63, i.e. when the average value KO2PG is largely or abruptly decreasing in the direction of correcting the air-fuel ratio toward a leaner side, execution of the steps S65 et seq is inhibited. That is, when QPGP > QPGPH holds at the step S65 (the estimated possible purging flow rate is large), the flag FPGSB can be set to 1 at the step S70 so that the purging gas flow rate is increased to a larger value. However, execution of the step S65 et seq is inhibited in this case. Therefore, it can be prevented that the air-fuel ratio abruptly changes due to increase of the purging gas flow rate in a transient state where the average value in a KO2PG is abruptly decreasing in the direction of correcting air-fuel ratio toward a leaner side due to enriching of the air-fuel ratio when the vapor amount is increased.

The above-mentioned first and second predetermined flow rates QPGPH, QPGPL are set to smaller values as the engine coolant temperature TW is higher when the ignition switch of the engine is turned on. This is advantageous in the case where the engine is once stopped and then restarted after warming-up thereof.

As described above, also in the second embodiment, by comparing between the average value KO2PG of the air-fuel ratio correction coefficient KO2 and the predetermined values KPGLMH, KPGLML, the affection of purging of the evaporative fuel upon the air-fuel ratio can be grasped accurately to thereby properly control the purging gas flow rate such that the control responsiveness in the air-fuel ratio control can be improved and the capacity of the evaporative fuel-emission suppression system can be exhibited to the full extent.

Furthermore, since the estimated value of possible purging gas flow rate QPGP is calculated as a function of the engine rotational speed NE and the throttle valve opening θTH, and the control of opening and closing of the purge control valves is carried out based upon the calculated estimated flow rate QPGP, fluctuations in the air-fuel ratio can be prevented, which would otherwise be caused by opening and closing of the purge control valves. As a result, a torque shock due to an abrupt change in the air-fuel ratio can be prevented.

As described in detail above, according to the invention, since the purge control valves are controlled in response to the average value of the air-fuel ratio correction coefficient, it is possible to accurately grasp the influence of purging effected over a long time period upon the air-fuel ratio to thereby control the purging gas flow rate. As a result, it can be prevented that the air-fuel ratio correction coefficient is deviated from its central value, and hence degraded control responsiveness in the air-fuel ratio control can be avoided, which is caused by the deviation of the air-fuel ratio correction coefficient from its central value at the transition from air-fuel ratio open loop control mode to air-fuel ratio feedback control mode. Besides, the evaporative fuel-emission suppression system can exhibit its full capacity.

Further, according to the invention, since the purging gas flow rate is reduced as the vapor amount (vapor concentration) is larger, the air-fuel ratio of the mixture supplied to the engine can be stably accurately controlled to a desired value, thereby preventing torque shock due to an abrupt change in the air-fuel ratio.

What is claimed is:

1. In an evaporative fuel-purging control system for an internal combustion engine having an intake system, an exhaust system, a fuel tank, a canister in which evaporative fuel from said fuel tank is adsorbed, purge control valve means arranged between said canister and said intake system for controlling a flow rate of said evaporative fuel supplied from said canister to said intake system, an exhaust gas ingredient concentration sensor arranged in said exhaust system, and air-fuel ratio control means responsive to an output from said exhaust gas ingredient concentration sensor for calculating an air-fuel ratio correction coefficient based upon said output from said exhaust gas ingredient concentration sensor and controlling the air-fuel ratio of a mixture supplied to said engine by the use of said air-fuel ratio correction coefficient, the improvement comprising:

calculating means for calculating an average value of said air-fuel ratio correction coefficient; and purge control means responsive to said average value calculated by said calculating means for controlling said purge control valve means in a manner such that when said average value of said air-fuel ratio correction coefficient is below a predetermined value, the flow rate of said evaporative fuel supplied by said purge control valve means is decreased, said purge control means including means for correcting said predetermined value by a second average value of said air-fuel ratio correction coefficient calculated when the supply of said evaporative fuel to said intake system is stopped.

2. An evaporative fuel-purging control system as claimed in claim 1, wherein said predetermined value is a lower limit of said first mentioned average value of said air-fuel ratio correction coefficient above which the air-fuel ratio of said mixture supplied to said engine can be controlled with desired control responsiveness.

3. In an evaporative fuel-purging control system for an internal combustion engine having an intake system, an exhaust system, a fuel tank, a canister in which evaporative fuel from said fuel tank is adsorbed, a plurality of purge control valves arranged between said canister and said intake system for controlling a flow rate of said evaporative fuel supplied from said canister to said intake system, an exhaust gas ingredient concentration sensor arranged in said exhaust system, and air-fuel ratio control means responsive to an output from said exhaust gas ingredient concentration sensor for calculating an air-fuel ratio correction coefficient based upon said output from said exhaust gas ingredient concentration sensor and controlling the air-fuel ratio of a mixture supplied to said engine by the use of said air-fuel ratio correction coefficient, the improvement comprising:

calculating means for calculating an average value of said air-fuel ratio correction coefficient; and selector means responsive to said average value calculated by said calculating means for selectively operating said purge control valves in a manner such that when said average value of said air-fuel ratio correction coefficient is below a predetermined value, the flow rate of said evaporative fuel supplied by said purge control valves is decreased, said selector means including means for correcting said predetermined value by a second average value of said air-fuel ratio correction coefficient calculated when the supply of said evaporative fuel to said intake system is stopped.

4. An evaporative fuel-purging control system as claimed in claim 3, wherein said selector means changes over said purge control valve means in a manner such that when said average value of said air-fuel ratio correction coefficient increases above a predetermined valve, the flow rate of said evaporative fuel supplied by said purge control valve means is increased.

5. An evaporative fuel-purging control system as claimed in claim 3, wherein said predetermined value is a value slightly smaller than a reference central value of said average value of said air-fuel ratio correction coefficient.

6. An evaporative fuel-purging control system as claimed in claim 3, wherein said predetermined value is a lower limit of said first mentioned average value of said air-fuel ratio correction coefficient above which the air-fuel ratio of said mixture supplied to said engine can be controlled with desired control responsiveness.

7. An evaporative fuel-purging control system as claimed in claim 3, wherein said selector means estimates a flow rate of said evaporative fuel which can be supplied to said intake system and changes over said purge control valves in response to the estimated flow rate.

8. An evaporative fuel-purging control system an claimed in claim 3, 4, 5, 6 or 7, wherein said selector means reserves changing over said purge control valves in a direction of increasing the flow rate of said evaporative fuel, when said average value of said air-fuel ratio correction coefficient has changed by a predetermined amount or more in a direction of correcting the air-fuel ratio of said mixture supplied to said engine toward a leaner side.

9. An evaporative fuel-purging control system as claimed in claim 1, 2, 3, 4, 5 or 6, wherein said average value of said air-fuel ratio correction coefficient is calculated when the air-fuel ratio of said mixture supplied to said engine is feedback controlled in response to said output from said exhaust gas ingredient concentration sensor.

10. An evaporative fuel-purging control system as claimed in claim 9, wherein said average value of said air-fuel ratio correction coefficient is calculated when said engine is in a stable condition and at the same time said evaporative fuel is supplied to said intake system.

* * * * *